US012765643B2

(12) United States Patent
Borsoi et al.

(10) Patent No.: US 12,765,643 B2
(45) Date of Patent: Oct. 20, 2026

(54) FOOTWEAR WITH CROSSING SUPPORTS

(71) Applicant: DECKERS OUTDOOR CORPORATION, Goleta, CA (US)

(72) Inventors: Bruno Borsoi, Vittorio Veneto (IT); Jean-Luc Diard, Annecy (FR)

(73) Assignee: Deckers Outdoor Corporation, Goleta, CA (US)

( * ) Notice: Subject to any disclaimer, the term of this patent is extended or adjusted under 35 U.S.C. 154(b) by 0 days.

(21) Appl. No.: 18/922,724

(22) Filed: Oct. 22, 2024

(65) Prior Publication Data

US 2025/0127267 A1 Apr. 24, 2025

Related U.S. Application Data

(60) Provisional application No. 63/592,407, filed on Oct. 23, 2023.

(51) Int. Cl.
*A43C 11/14* (2006.01)

(52) U.S. Cl.
CPC ..... *A43C 11/1493* (2013.01)

(58) Field of Classification Search
CPC ..... A43C 11/1493; A43C 11/00; A43B 3/126; A43B 3/12
USPC ..... 36/25 R
See application file for complete search history.

(56) References Cited

U.S. PATENT DOCUMENTS 5,651,195 A * 7/1997 Clancy ..... A43B 3/12 36/11.5
6,052,920 A * 4/2000 Bathum ..... A43B 3/0052 36/114
6,493,965 B1 * 12/2002 Bathum ..... A43B 7/1415 36/7.7
D487,620 S * 3/2004 Robbins ..... D2/969
7,320,188 B2 1/2008 Bathum
D564,199 S * 3/2008 Belley ..... D2/917
7,793,436 B2 9/2010 Sink
11,000,098 B2 5/2021 Fogg et al.
2002/0088141 A1 * 7/2002 Matis ..... A43B 3/128 36/12
2022/0312896 A1 10/2022 Bendzak et al.

FOREIGN PATENT DOCUMENTS

CN 219613176 U 9/2023

OTHER PUBLICATIONS

PCT Application [PCT/US2024/052462]: PCT Search Report and Written Opinion, Dec. 30, 2024 (8 pages).
Cole Haan website listing, Men's 5.ZERØGRAND Monk Strap Running Shoe in Dark Gray | Cole Haan, dated Nov. 20, 2023, https://www.colehaan.com/mens-5.zerogrand-monk-strap-running-shoe%C2%A0/196414246254.html?amp%3Bgad_source=1&amp%3Bgclid=Cj0KCQiAmNeqBhD4ARIsADsYfTe_sEgy1Fcm1tokPV4yNkqukEbJAI4tiHLNKkqgow0DF1YY2CPdJeQaAhNSEALw_wcB&amp%3Bgclsrc=aw.ds&amp%3BglCountry=US&amp%3BglCurrency=USD&amp%.

* cited by examiner

*Primary Examiner* — Timothy K Trieu
(74) *Attorney, Agent, or Firm* — Greer, Burns & Crain, Ltd.

(57) ABSTRACT

An article of footwear is provided and includes a sole and an upper attached to the sole and the upper includes an inner support and an outer support. The outer support is positioned on the inner support and includes a strap assembly, where the strap assembly includes at least one strap that extends between a medial side and a lateral side of the sole, and the at least one strap is connected to two connecting points on the lateral side of the sole and to three connecting points on the medial side of the sole.

17 Claims, 15 Drawing Sheets

FOOTWEAR WITH CROSSING SUPPORTS

CROSS-REFERENCE TO RELATED APPLICATION

This application is a non-provisional application of and claims priority to U.S. Provisional Patent Application No. 63/592,407 filed on Oct. 23, 2023, the entire contents of which is incorporated herein by reference.

BACKGROUND

The present application relates generally to footwear, and more particularly, to a sandal including an upper attached to a sole where the upper has an inner support and an outer support that combine to securely support a user's feet while walking, jogging or running.

Footwear, such as a sandal, typically includes a sole and an upper attached to the sole where the upper includes a foot opening for a user to insert their foot. After inserting their foot in the opening, the user adjusts the fit of the shoe on their foot by adjusting the position of the upper relative to their foot using laces or straps on the upper. The fit of the shoe is important to the comfort, support and stability provided to users' feet during movement.

Several types of lacing and closure systems have been used to secure a closed shoe, such as a running shoe, to a user's foot. Such shoes have uppers that enclose a user's foot and have additional support on the medial and lateral sides of the shoe to provide stability, support and comfort to a users' feet on different types of terrain.

Conventional sandals do not provide the same stability, support and comfort to users' feet on different terrain as with running shoes or trail shoes. Although sandals are breathable and lightweight, they do not provide sufficient support to user's feet on challenging terrain and a users' feet have a tendency to slide forward in sandals when moving downhill. Sandals also do not provide sufficient control and support during jogging or running. Also, the straps on sandals press and/or rub on a users' feet during movement causing discomfort in pressure points on the user's feet.

It is therefore desirable to provide a sandal having an upper with a strap and cushioning system that enhances the comfort of the sandal on a user's foot while providing sufficient support, stability and control during movement on different types of terrain.

SUMMARY

The present invention article of footwear includes a sole and an upper attached to the sole, where the position of the upper relative to a user's foot is adjustable to adjust the comfort and fit of the upper relative to the user's foot so as to accommodate feet having different shapes and sizes.

In an embodiment, an article of footwear is provided and includes a sole and an upper attached to the sole and the upper includes an inner support and an outer support. The outer support is positioned on the inner support and includes a strap assembly, where the strap assembly includes at least one strap that extends between a medial side and a lateral side of the sole, and the at least one strap is connected to two connecting points on the lateral side of the sole and to three connecting points on the medial side of the sole.

In another embodiment, an upper for an article of footwear is provided and includes an inner support and an outer support, where the outer support is positioned on the inner support and includes a strap assembly. The strap assembly includes at least one strap that extends between a medial side and a lateral side of the sole, where the at least one strap is connected to two connecting points on the lateral side of the sole and to three connecting points on the medial side of the sole.

DETAILED DESCRIPTION

The present invention is for an article of footwear, and more specifically, a sandal having an upper with an inner support, and an outer support including a strap system, where the inner support and the outer support combine to provide comfort, support and stability to a user's foot during walking, jogging and running on different terrain.

Figure 1:
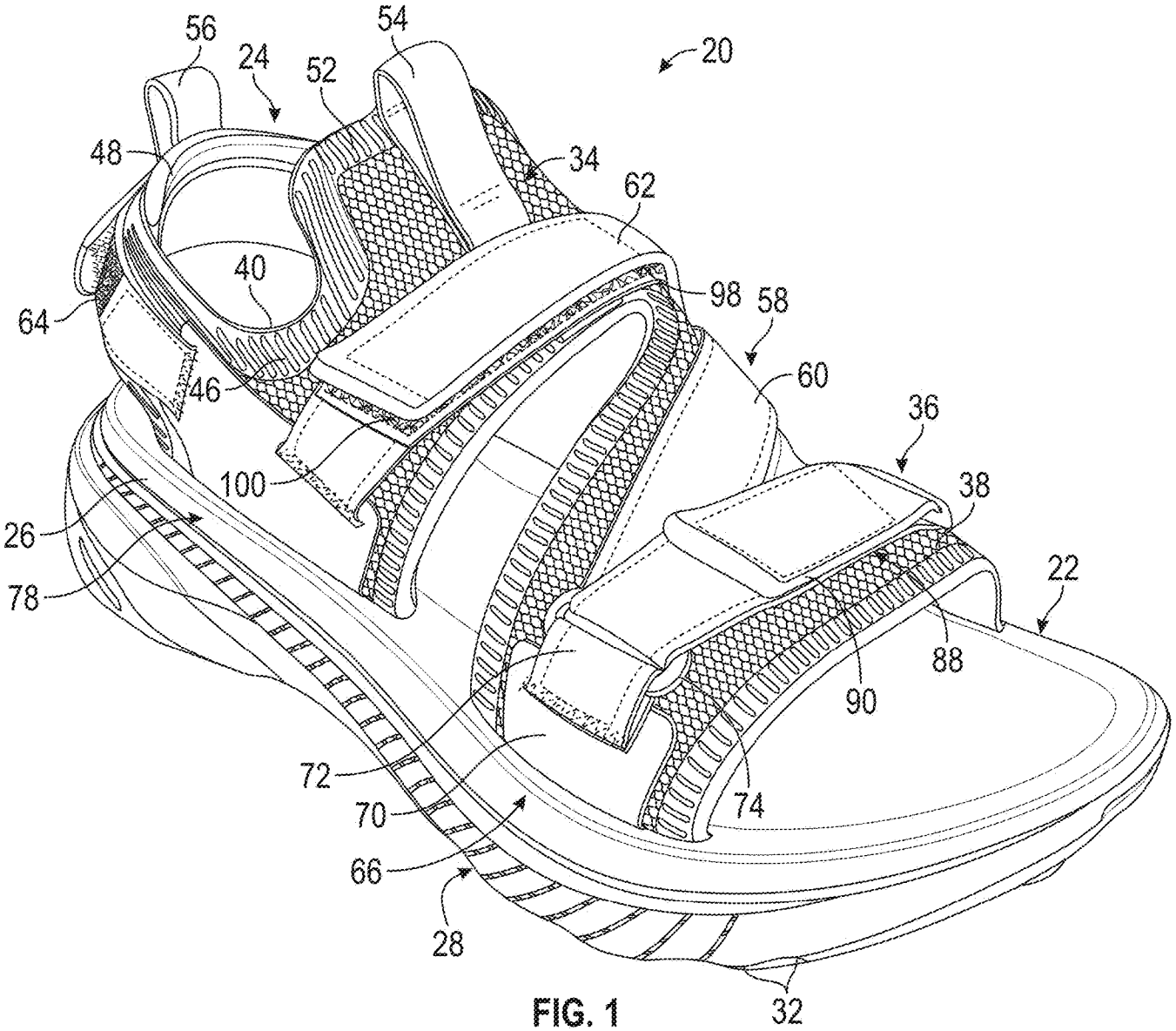
FIG. 1 is a perspective view of an embodiment of an article of footwear including the support assembly.

Referring to FIGS. 1-4, an embodiment of an article an article of footwear 20 is shown where the article of footwear 20 includes a sole, generally indicated as 22, where the sole 22 is attached to an upper 24. The sole 22 may be an integral, molded component made of a material having a designated hardness value or made with different materials having the same or different hardness values. As shown in FIG. 1, the upper 24 is attached to the sole 22 by sewing the upper on the sole using stitching. The upper 24 may also be attached to the sole 22 using an adhesive, attached by molding the upper to the sole or at least partially molding the upper within the sole or using any suitable attachment method or combination of methods, such as attaching the upper to the sole using an adhesive and stitching. In the illustrated embodiment, the sole includes a midsole 26 and an outsole 28 where the outsole 28 is attached to a bottom surface 30 of the midsole 26 by an adhesive or by molding. In an embodiment, the midsole is made of ethylene vinyl acetate (EVA) and the outsole is made of rubber, where it is contemplated that the sole, i.e., the midsole and the outsole, may made out of any suitable material or combination of materials. In the illustrated embodiment, the outsole 26 includes a plurality of tread members 32 that are configured to grip an underlying surface, such as the ground, during movement. In another embodiment, the article of footwear 20 does not have an outsole, where the bottom surface of the sole, and more specifically, the midsole, directly contacts an underlying surface.

In an embodiment, the upper 24 includes an inner support 34 and an outer support 36 where the inner support 34 is positioned adjacent to an inner surface of the outer support 36. The inner support 34 shown in FIG. 1 is made with a stretchable fabric material, such as a nylon material, a blended fabric material, a foam material or any suitable material or combination of materials, and is attached to the sole 22 by being molded with the sole, attached to the sole using stitching or an adhesive or by any suitable attachment method of combination of attachment methods. In the illustrated embodiment, the inner support 34 includes a front portion 38 and a rear portion 40 where the front portion and the rear portion are attached together on a medial side 42 of the sole 22. As shown, the front portion 38 is attached to the lateral side 44 of the sole 22 and attached to the medial side 42 of the sole 22. The width W (distance between the front edge 46 and the rear edge 48) of the front portion 38 gradually increases from the lateral side 44 to the medial side 42 and extends over the forefoot of a user's foot during use. The width W of the front portion 38 provides support to the forefoot of a user's foot. In another embodiment, the width W of the front portion 38 gradually increases from the medial side 42 to the lateral side 44. It should be appreciated that the width W may be the same between the lateral side 44 and the medial side 42 of the sole 22 or the width W may gradually decrease or increase from the lateral side 44 to the medial side 42 of the sole 22.

The rear portion 40 of the inner support 34 includes a midfoot member 46 (FIG. 4) that extends over a user's foot and is attached to the lateral side 44 and the medial side 42 of the sole 22. A heel member 48 (FIG. 3) is attached to the lateral side 44 and the medial side 42 of the rear portion 40 and extends around a user's foot and more specifically, around a user's heel. The midfoot member 46 and the heel member 48 define a foot opening 50 configured to receive a user's foot where the user's foot is moved through the foot opening 50 and under at least part of the rear portion 40 and under the front portion 38 of the inner support 34. The midfoot member 46 includes a tongue 52 that enables a user to grasp the tongue and at least partially lift the rear portion 40 of the inner support 34 to facilitate the insertion of the user's foot through the foot opening 50. It should be appreciated that the tongue 52 may have any suitable shape, width and length. In an embodiment, a tongue strap 54 is attached to the tongue 52 and a heel strap 56 is attached to the heel member 48, where the tongue strap and the heel strap each form a loop that is configured to receive one or more fingers of a user's hand to enable a user to easily grasp and manipulate the tongue strap 54 and the heel strap 56. It should be appreciated that the inner support 34 may include only the tongue strap 54, only the heel strap 56 or no straps. In this embodiment, the inner support 34 has a designated material thickness to provide comfort and support to a user's foot. In another embodiment, the front portion 38 and the rear portion 40 of the inner support 34 have the same thickness. In a further embodiment, the front portion 38 and the rear portion 40 of the inner support 34 have different thicknesses. It should be appreciated that the thickness of the material or materials forming the inner support 34 may be different at different areas of the user's foot to customize the comfort and support provided to the user's foot.

Figure 2:
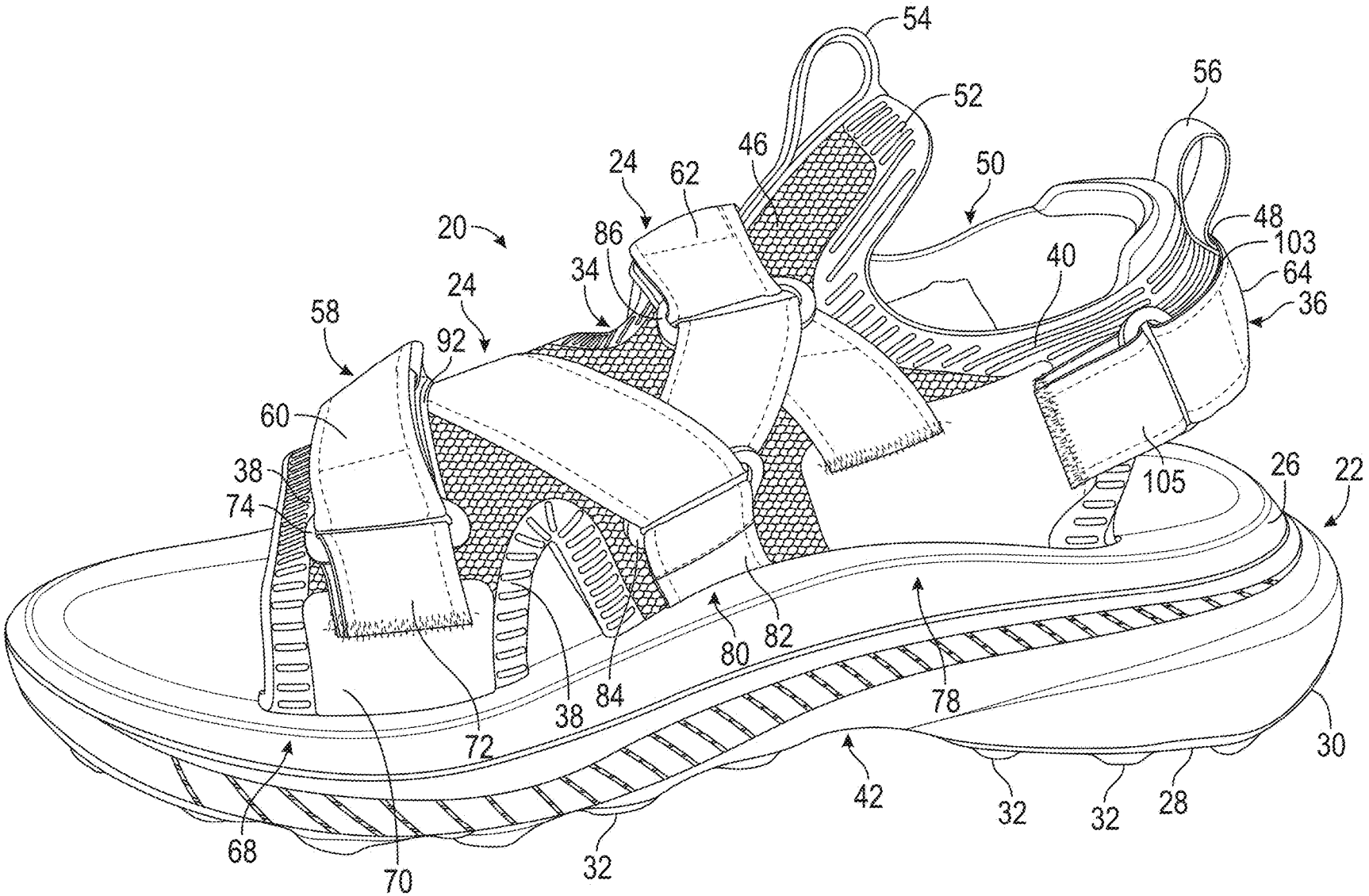
FIG. 2 is a left side view of the article of footwear of FIG. 1.
Figure 3:
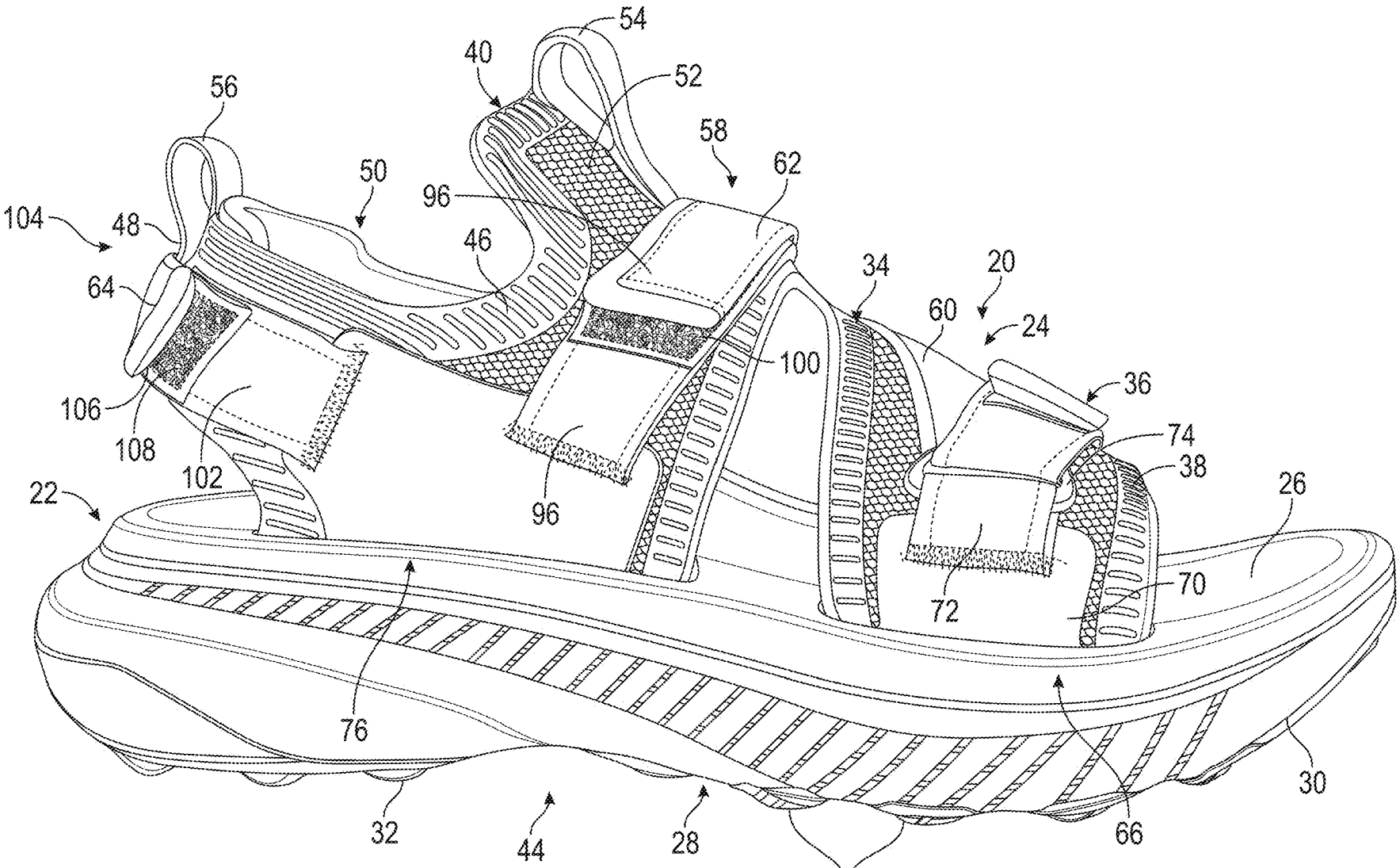
FIG. 3 is a right side view of the article of footwear of FIG. 1.
Figure 4:
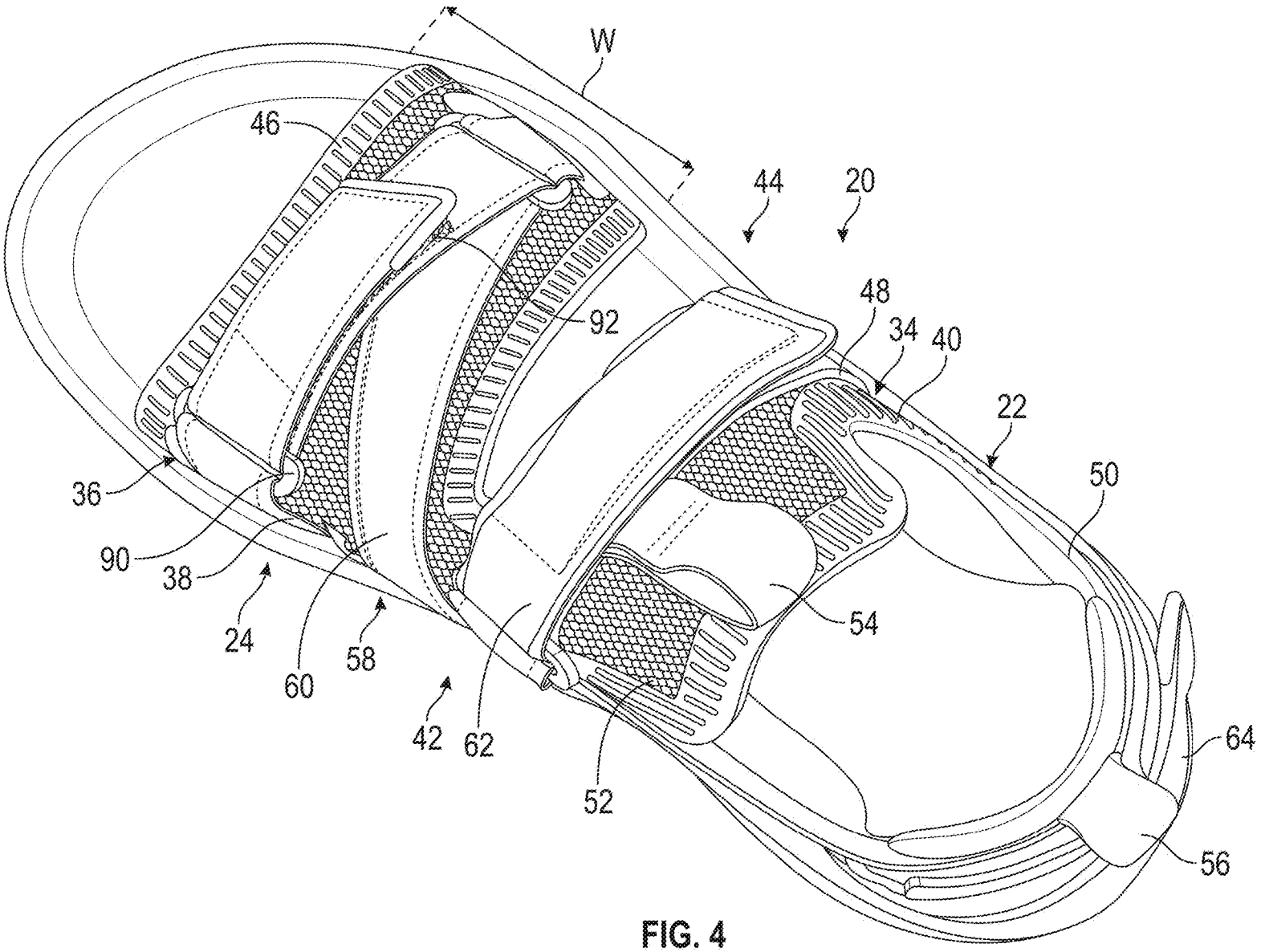
FIG. 4 is a top view of the article of footwear of FIG. 1.

Referring to FIGS. 2-4, the outer support 36 includes a strap assembly 58 comprised of a plurality of straps that extend over and about a user's foot. Specifically, the outer support 36 is positioned on the inner support 34 as shown in FIGS. 1 and 4 and includes a first strap 60, a second strap 62 and a third strap 64 that are each adjustable and combine to adjust the comfort and support of the upper 24 on a user's foot.

As shown, a first connecting member 66 is attached to the lateral side 44 of the sole 22 and a second connecting member 68 is attached to the medial side 42 of the sole 22, where the first and second connecting members 66, 68 are attached to the sole 22 by being molded with the sole, attached to the sole by stitching or an adhesive or by any suitable attachment method or combination of attachment methods. The first and second connecting members 66, 68 each include a connecting tab 70, a connecting strap 72 attached to the tab and a connecting ring 74 where the connecting strap 72 extends through the ring 74 and the ends of the connecting strap 72 are attached to the tab 70.

Additional connections are provided by a third connecting member 76 positioned on the medial side 42 of the sole 22 and fourth connecting member 78 positioned on the lateral side 44 of the sole 22. The third and fourth connecting members 76, 78 are each made with EVA or similar material that had a hardness value that is greater than a hardness value of the material or materials used to make the inner support 34. In this way, the third and fourth connecting members 76, 78 provide rigidity and additional support to portions of the outer surface of the inner support 34. Additionally, a fifth connecting member 80 is attached to the lateral side 44 of the sole 22 between the second connecting member 68 and the fourth connecting member 78 as shown in FIG. 2. The fifth connecting member 80 includes a connecting strap 82 having an end extending through a connecting ring 84 where the end of the connecting strap 82 is attached to itself to secure the strap to the connecting ring 84.

Regarding the strap assembly, 58, an end of the first strap 60 of the outer support 36 is attached to the fourth connecting member 78 by stitching and the first strap is then sequentially inserted through an intermediate connecting ring 86 (FIG. 2), the connecting ring 84 of the fifth connecting member 80, the connecting ring 74 of the first connecting member 66 and the connecting ring 74 of the second connecting member 68. As shown, a bottom surface 88 of the end of the first strap 60 includes a first attachment member 90, such as hooks, that attaches to a second attachment member 92, such as loops, on a portion of the first strap to secure the first attachment member to the second attachment member and temporarily fix the position of the first strap 60 on the inner support 34. The position of the first strap 60 on the inner support 34, i.e., loosening or tightening the first strap, may be adjusted by changing the position of the first attachment member 90 on the second attachment member 92. It should be appreciated that the first attachment member 90 and the second attachment member 92 may be secured together using a snap connector, a buckle connector or any suitable connector.

The second strap 62 has a first end 94 attached to the third connecting member 76 by stitching or other suitable attachment method, and a second end 96 that is inserted through the intermediate ring 86 and folded back upon itself. The second end 96 of the second strap 62 is secured in position by attaching a first attachment member 98 on the bottom surface of the second strap 62 to a second attachment member 100 on an upper surface of the second strap 62. The first and second attachment members 98, 100 may be any suitable attachment members as described above. As shown, the second strap 62 is positioned adjacent to the foot opening 50 and is used to adjust the position of the inner support 34 relative to the user's foot by moving the position of the first attachment member 98 relative to the second attachment member 100, i.e., loosening or tightening the second strap.

A first end 102 of the third strap 64 is attached to an intermediate connecting ring 103, which is attached to an intermediate strap 105, where the intermediate strap 105 is attached to the third connecting member 76 by stitching or other suitable attachment method. A second end 104 of the third strap 64 is positioned about the heel member 48 of the inner support 34 and is inserted through the connecting ring 84 attached to the fourth connecting member 78 and folded upon itself as shown in FIG. 2. The second end 104 of the third strap 64 is secured in position by attaching a first attachment member 106 on the bottom surface of the third strap 64 to a second attachment member 108 on an upper surface of the third strap. The third strap 64 is adjusted by moving the position of the first attachment member 106 relative to the second attachment member 108, i.e., loosening or tightening the third strap 64, relative to the heel of a user's foot.

In the above embodiment, the first strap 60, the second strap 62 and the third strap 64 are each made of a durable material, such as a nylon material, but may be made with an elastic material or any suitable material or combination of materials. Further, the position of where the first strap is attached to the fourth connecting member 78 and the positions of the connecting rings 74 and 84 along the medial side of the upper may be adjusted to adjust the amount of support provided by the strap assembly and the location of the support on a user's foot on the medial side of the upper.

After inserting a foot in the foot opening 50 of the upper 24, the third strap 64 is adjusted to center the foot in the sandal and then the portion of the first strap 60 over the toes is adjusted to center this portion over the forefoot area of the foot. Next, the first strap 60 is further adjusted to cross the forefoot area of the foot below the instep and then above the instep to provide a secure fit on the foot and provide an even pressure distribution on the foot provided by the combination of the inner support 34 and the outer support 36 of the upper 24. The inner support 34 also provides cushioning between the strap assembly 58 and the user's feet to enhance the comfort of the sandal. Also, feet tend to pronate (roll inward toward the medial side of the foot) during jogging or running, which increases fatigue. The present sandal provides additional support and stability on the medial side 42 of the foot by using the three connecting points of the first strap 60 on the medial side 42 of the sole 22.

Figure 5A:
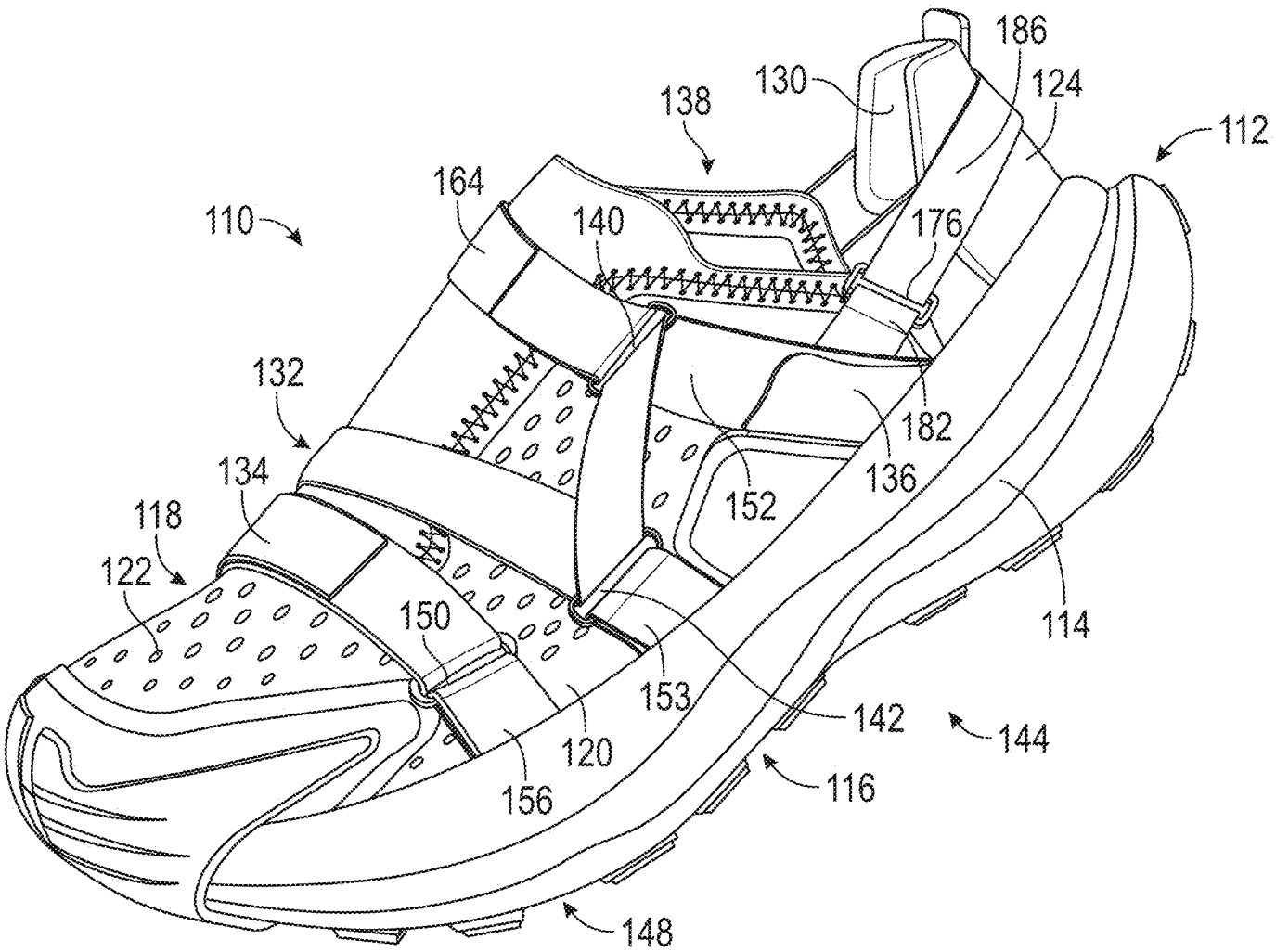
FIG. 5A is a perspective view of another embodiment of the article of footwear.
Figure 5B:
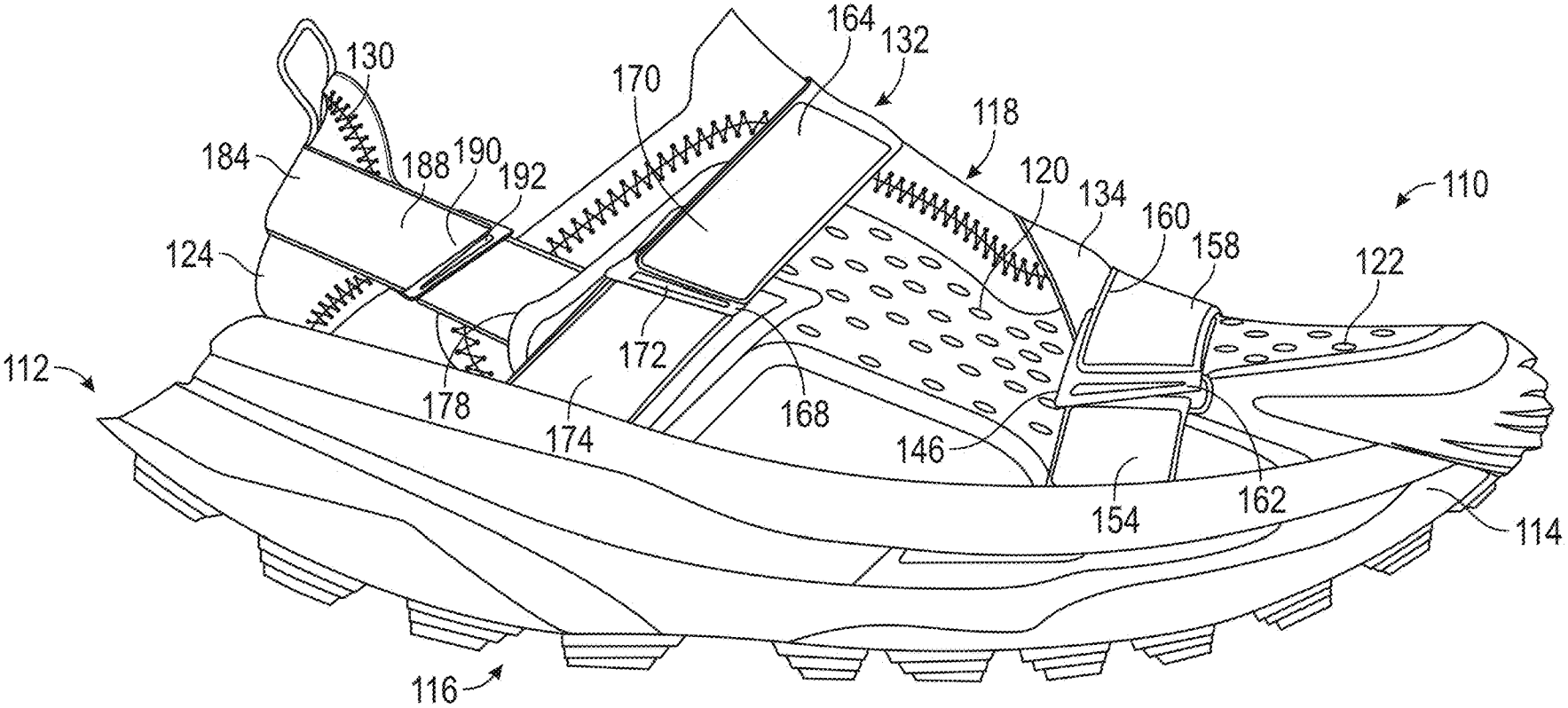
FIG. 5B is a side view of the article of footwear of FIG. 5A.
Figure 5C:
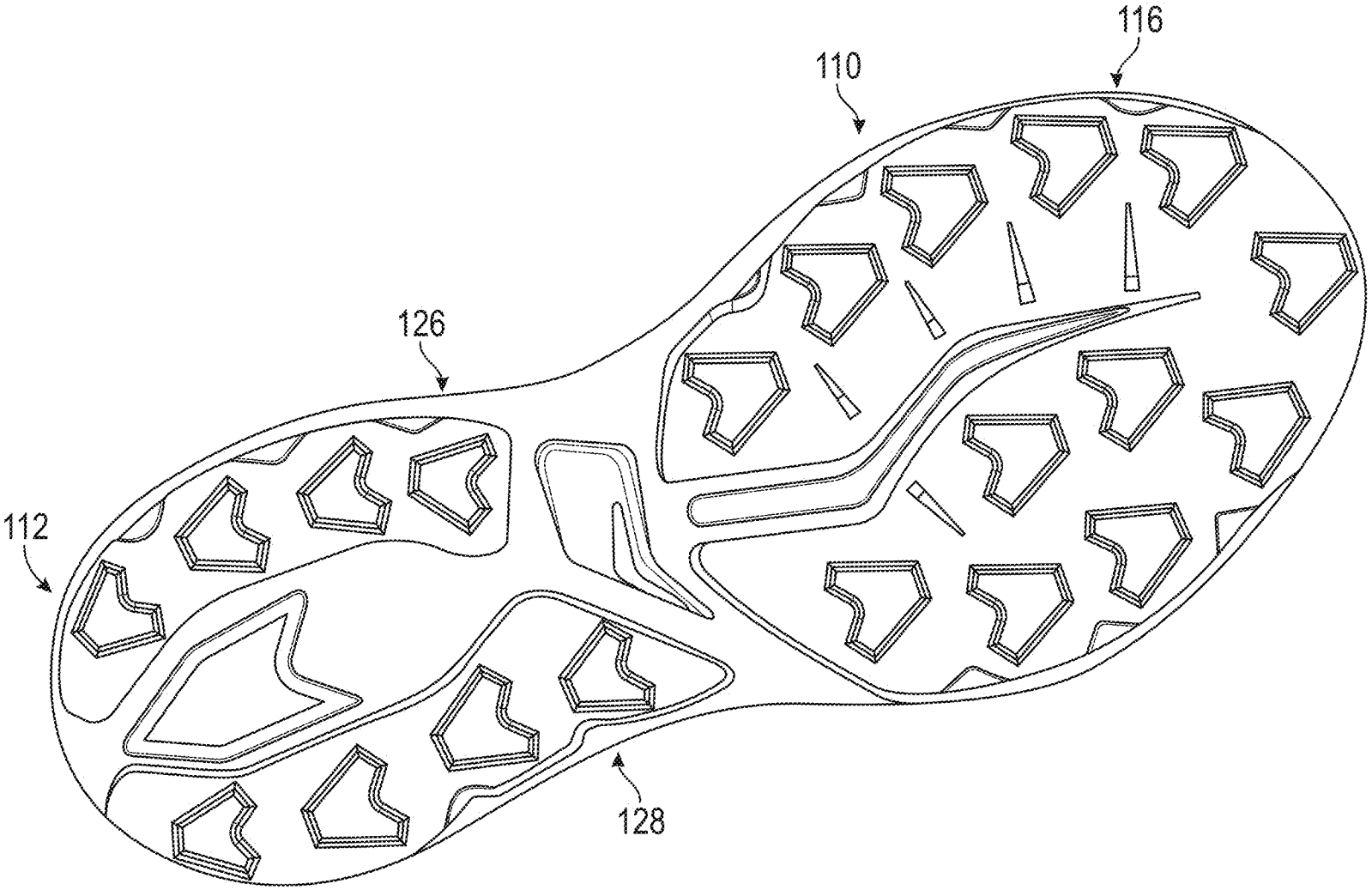
FIG. 5C is a bottom view of the article of footwear of FIG. 5A.

Referring to FIGS. 5A, 5B and 5C, another embodiment of the article of footwear is shown where the article of footwear 110 includes a sole 112 having a midsole 114 and an outsole 116 attached to a bottom surface of the midsole, and an upper 118 attached to the midsole 114. In this embodiment, the upper 118 includes an inner support 120 having a front portion 122 with a closed toe area, i.e., closed end with no openings, and a rear portion 124 the extends between a medial side 126 and a lateral side 128 of the front portion 122 and forms a heel area or heel 130 of the upper. An outer support, such as strap assembly 132, is positioned on the inner support 120 and secured to the midsole 114.

In the illustrated embodiment, the strap assembly 132 includes a first strap 134 attached to a first connecting member 136 attached to the midsole 114 at the foot opening 138 on a medial side 126 of the upper 118. The first strap 134 is inserted through a first connecting ring 140, a second connecting ring 142 at the midfoot area 144 on the medial side 126 of the sole 112, a third connecting ring 146 in the forefoot area 148 on the lateral side 128 of the sole 112 and a fourth connecting ring 150 in the forefoot area 148 on the medial side 126 of the sole 112. As shown, the end 152 of the first strap 134 is secured to a connecting member 136 attached to the midsole 114, the second, third and fourth connecting rings 142, 146, 150 are respectively secured to the midsole 114 by second, third and fourth connecting straps 153, 154 and 156. In this way, the first strap 134 is adjustable, i.e., tightened or loosened, relative to a user's foot by adjusting the position of the end 158 of the first strap 134 and then securing a first attachment member 160 on the end 158 of the first strap 134 to a second attachment member 162 on a surface of another portion of the first strap 134. It should be appreciated that the first and second attachment members 160 and 162 may be hook and loop attachment members or any suitable attachment members. The strap assembly 132 also includes a second strap 164 having an end 166 that is attached to the first connecting ring 140 and inserted through a fifth connecting ring 168. The second strap 164 is adjustable and secured in position by attaching the first attachment member 170 and the second attachment member 172 together as described above. The fifth connecting ring 168 is attached to a connecting strap 174, which is attached to the midsole 114. Further, the inner support 120 includes a medial connecting ring 176 and a lateral connecting member 178 that are attached to the front portion 122 by the connecting strap 174 and the medial connecting ring 182. A third strap 184 has a first end 186 that is secured to the medial connecting ring 176 or the lateral connecting member 178 and a second end 188 that is inserted through the opposing connecting ring (either the medial or lateral connecting ring). The third strap 184 extends across the heel 130 of the upper 118 and is adjustable and secured in position by a first attachment member 190 and a second attachment member 192 as described above. Similar to the above embodiments, the combination of the inner support 120 and the strap assembly 132 (outer support) provides enhanced stability and support to a user's foot during movement on different terrain.

Figure 6A:
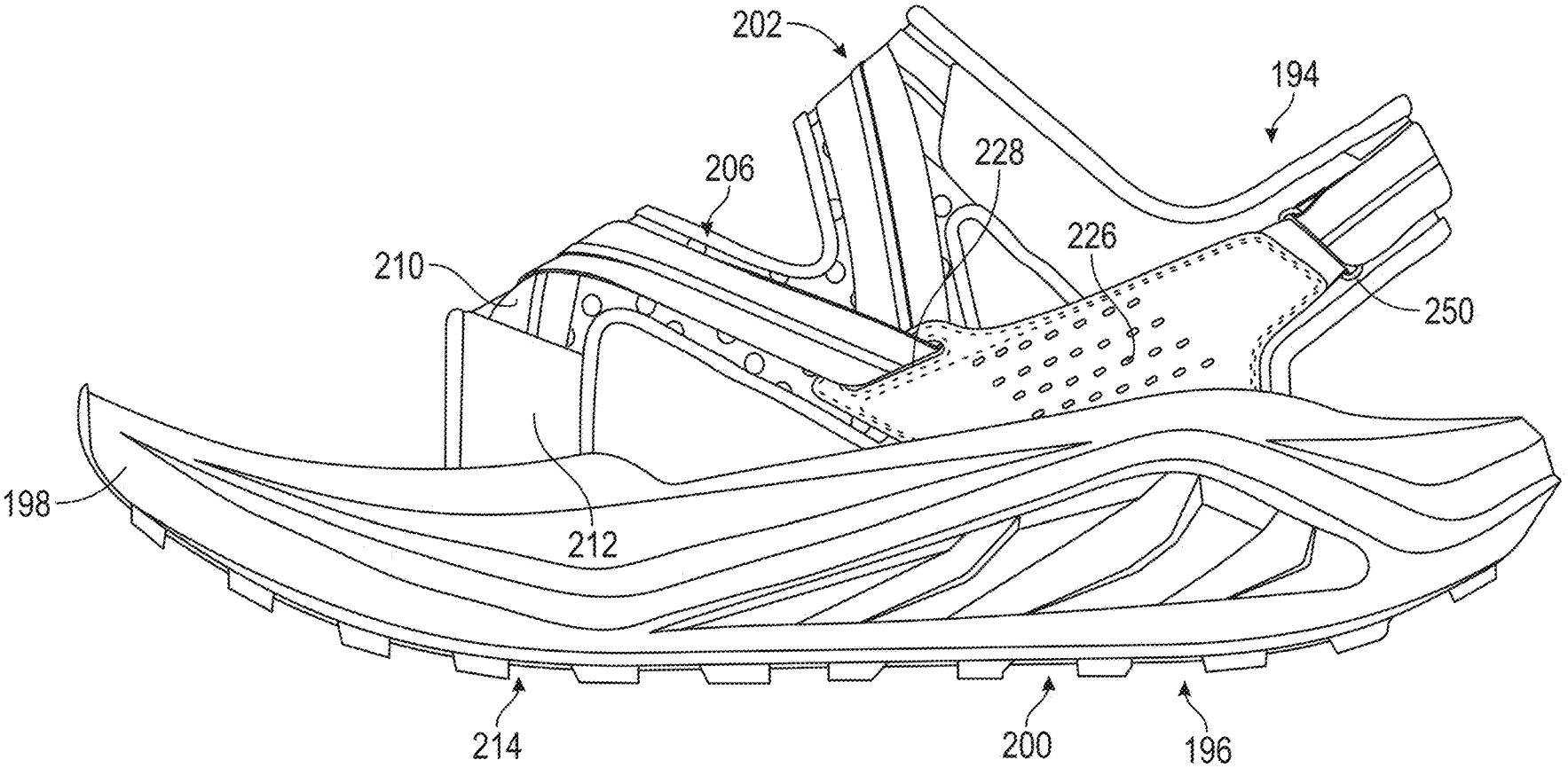
FIG. 6A is a left side view of a further embodiment of the article of footwear.
Figure 6B:
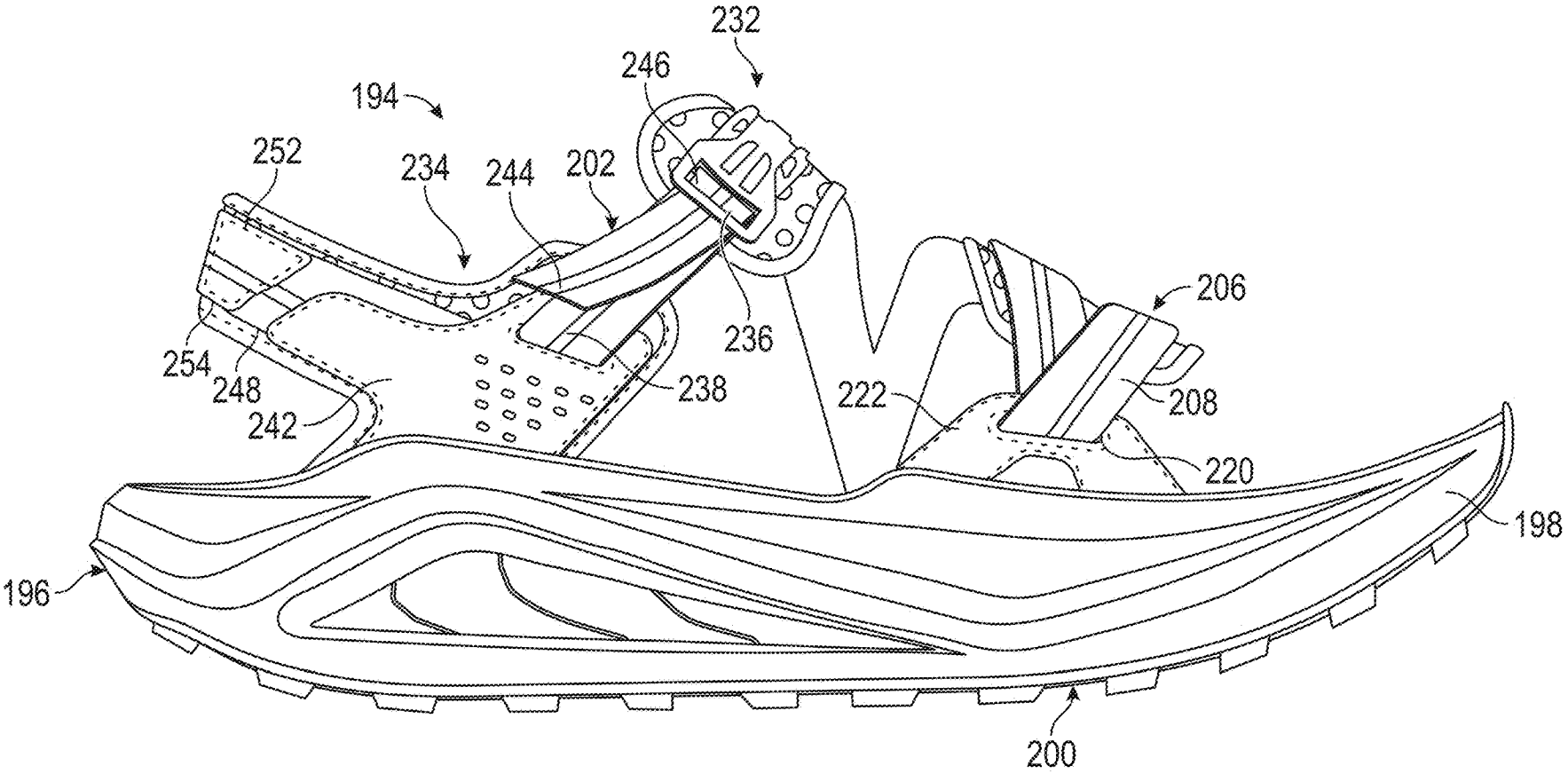
FIG. 6B is a right side view of the article of footwear of FIG. 6A.
Figure 6C:
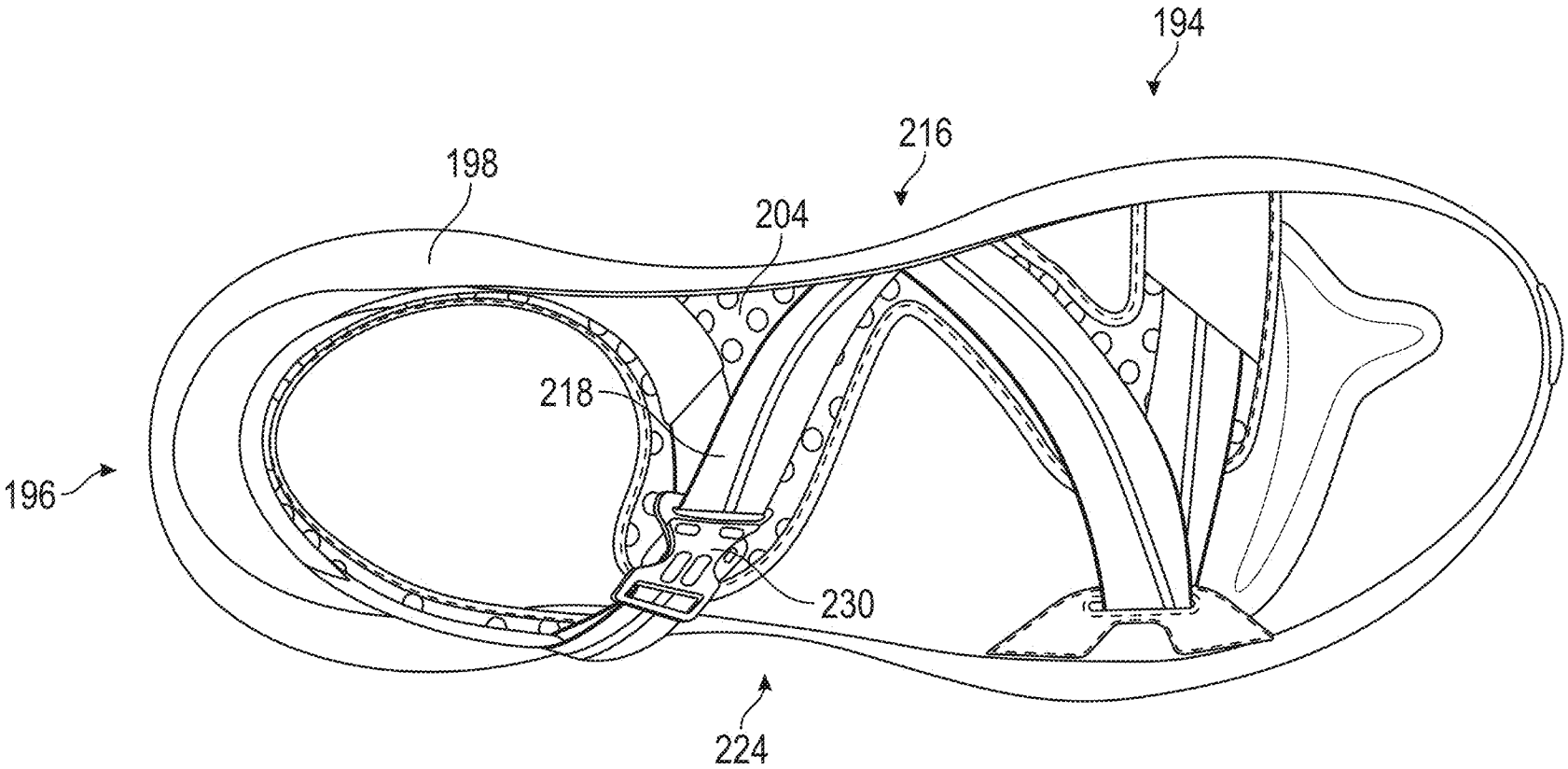
FIG. 6C is a top view of the article of footwear of FIG. 6A.

Referring to FIGS. 6A, 6B and 6C, a further embodiment of the article of footwear is shown where the article of footwear 194 includes a sole 196 having a midsole 198 and an outsole 200 attached to a bottom surface of the midsole 198, and an upper 202 attached to the midsole 198. In this embodiment, the upper 202 includes an inner support 204 and an outer support, such as strap assembly 206, that is positioned on the inner support 204 and secured to the midsole 198. The article of footwear 194 is similar to the above embodiments except that a shape and width of the inner support 204 corresponds to a shape and width of the straps of the strap assembly 206. Specifically, in the illustrated embodiment, the strap assembly 206 includes a first strap 208 having a first end 210 attached to a first connecting strap 212, which is attached to the midsole 198 in the forefoot area 214 on a medial side 216 of the upper 202. A second end 218 of the first strap 208 is inserted through a throughhole 220 in a v-shaped connecting member 222 attached to a lateral side 224 of the sole 196 and then extends across the forefoot area 214 of a user's foot to a connecting member 226 adjacent to the instep area or arch of the user's foot. The second end 218 is inserted through a throughhole 228 in the connecting member 226 and then extends across the user's foot to a first part 230 of a lock mechanism 232 that is adjacent to the foot opening 234. The lock mechanism 232 may be a buckle, a snap-type mechanism or any suitable lock mechanism, and includes a second part 236 that is removably connected to the first part 230. An end 238 of a second strap 240 is attached to a rear connecting member 242, where an opposing end 244 is insertable through a strap opening 246 in the second part 236. The strap opening 246 has teeth or another gripping mechanism that releasably grips the second strap to hold it in place. In this way, a length of the second strap 240 is adjusted, i.e., tightened or loosened, which in turn, adjusts a position of the first strap relative to a user's foot. A third strap 248 is attached to the rear connecting member 242 and inserted through a connecting ring 250 attached to connecting member 226. The third strap 248 has first and second attachment members 252 and 254 as described above to adjust the length of the third strap 248 and then secure the third strap in position. This embodiment thereby provides a secure fit and support to a user's foot while helping to reduce the amount of materials needed to construct the article of footwear.

Figure 7:
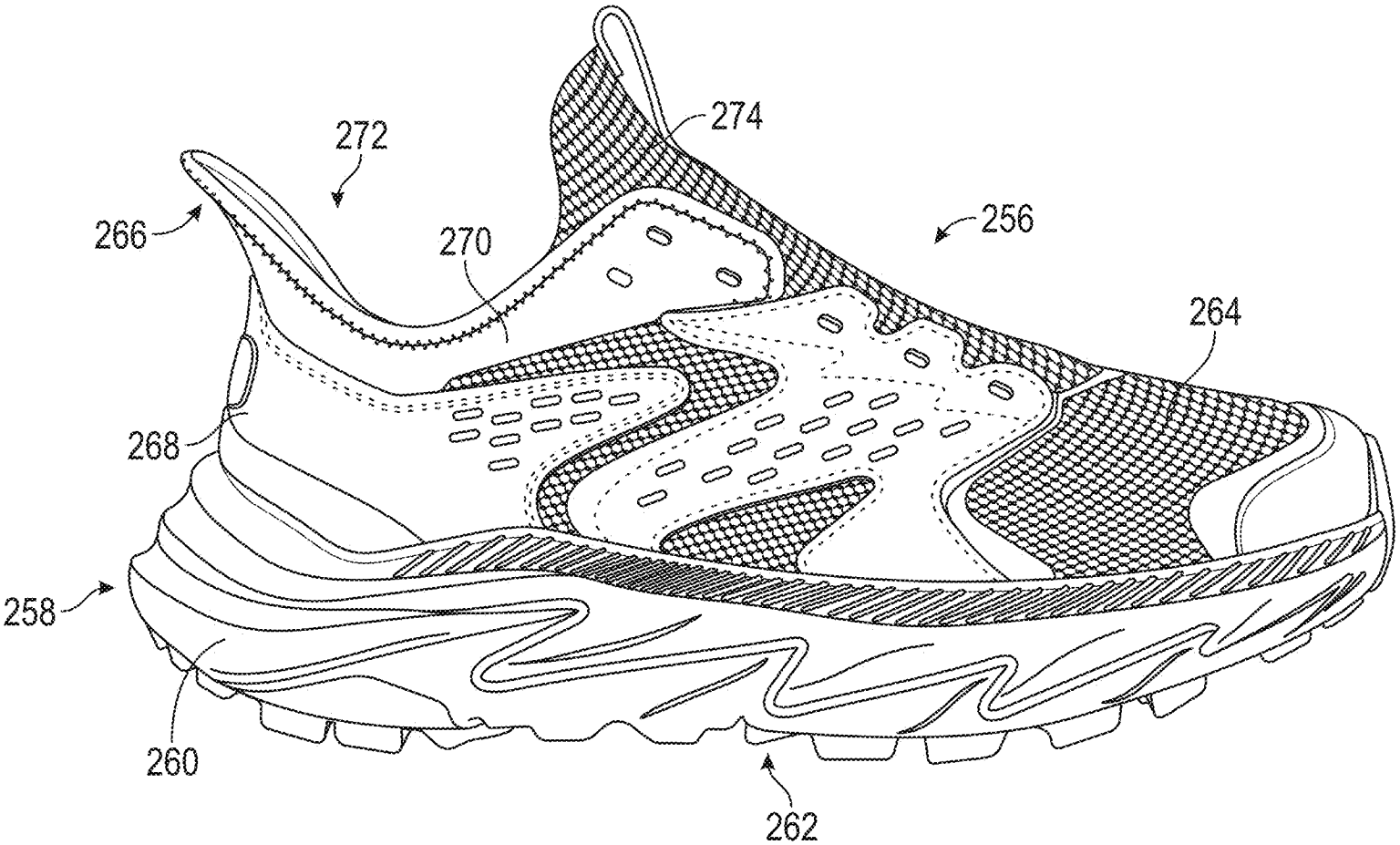
FIG. 7 is a side view of another embodiment of the article of footwear.
Figure 8:
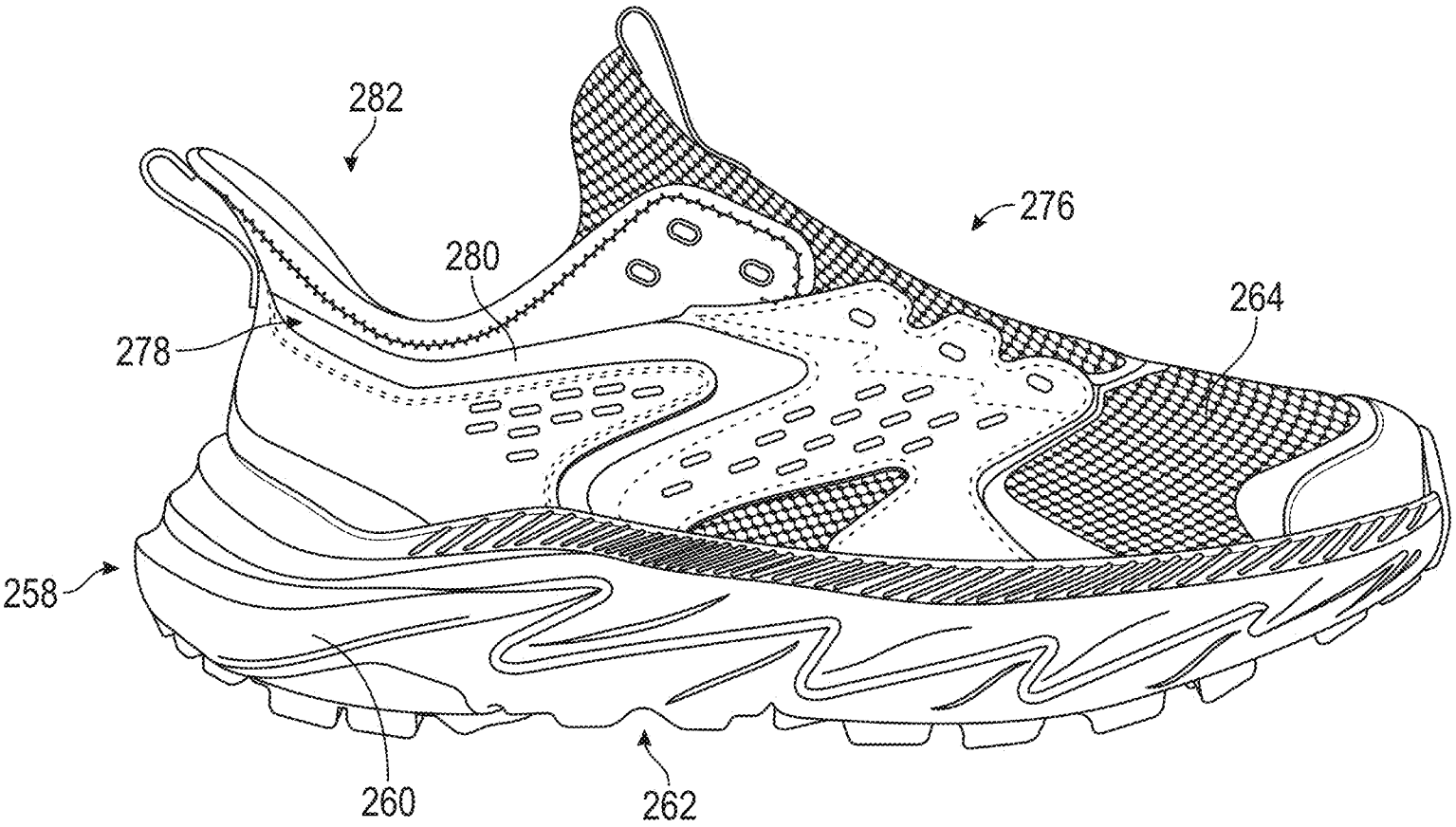
FIG. 8 is a side view of a further embodiment of the article of footwear.

Referring to FIGS. 7 and 8, additional embodiments of the article of footwear are shown where the article of footwear 256 includes a sole 258 having a midsole 260 and an outsole 262 attached to a bottom surface of the midsole, and an upper 264 attached to the upper surface of the midsole. As shown in FIG. 7, the heel support 266 is attached to a heel 268 of the upper 264 and has a lateral member 270 and/or a medial member 272 that each extend to the integrated tongue 274. Also, a portion of the heel support 266 is covered by the upper 264 to provide additional stability to the lower end of the heel support. The article of footwear 276 in FIG. 8 is similar to FIG. 7 where a portion of the heel support 278 is covered by the upper 264 in the heel 268. In this embodiment, the lateral member 280 and/or the medial member 282 of the heel support extend along the lateral side and/or the medial side of the upper 264 and to the midsole 260. It should be appreciated that the heel support may be attached to an outer surface of the upper 264 as described above, partially covered by the upper 264 or entirely enclosed within the upper 264.

Figure 9:
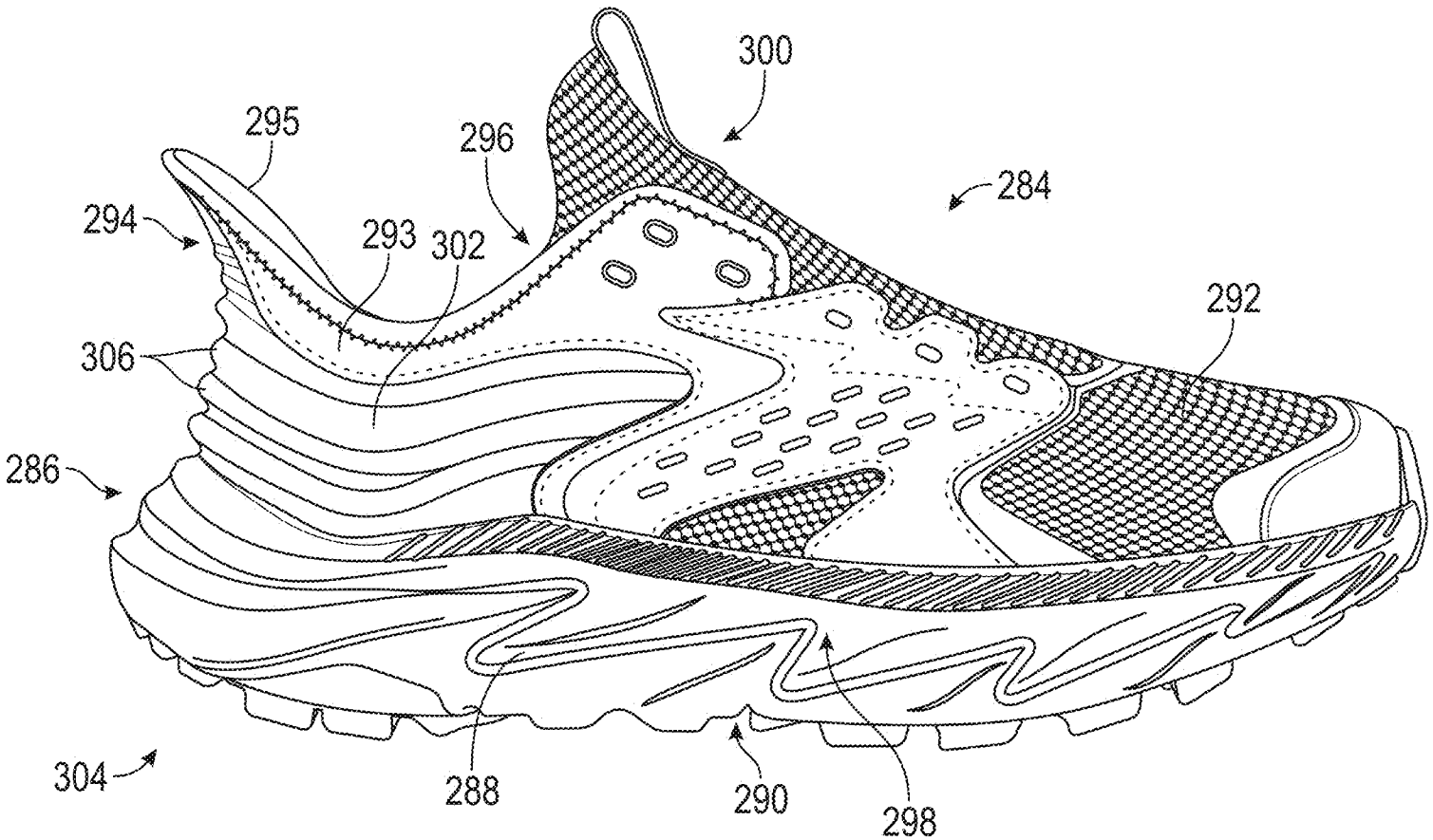
FIG. 9 is another embodiment of the article of footwear.

Referring to FIG. 9, another embodiment of the article of footwear is shown where the article of footwear 284 includes a sole 286 having a midsole 288 and an outsole 290 attached to a bottom surface of the midsole, and an upper 292 attached to an upper surface of the midsole 288. In this embodiment, the heel support 294 is attached to an outer surface 293 of the heel 295 of the upper 292 and includes a medial member 296 that at least partially extends to the midfoot area 298 on a medial side 300 of the sole 286, a lateral member 302 that at least partially extends to a lateral side 304 of the sole or a medial member and a lateral member that respectively extend at least partially along lateral members the medial side and the lateral side. Also, the heel support 294 includes ridges 306 that are spaced apart and extend laterally across the surface of the heel support 294 to the medial member 296 and/or the lateral member 302 of the heel support. In another embodiment, the heel support 294 is solely on the upper part of the heel 295 of the upper 292 and does not extend to the midsole 288. It should be appreciated that the heel support may extend along the entire length of the heel of the upper or along a portion of the heel.

Figure 10A:
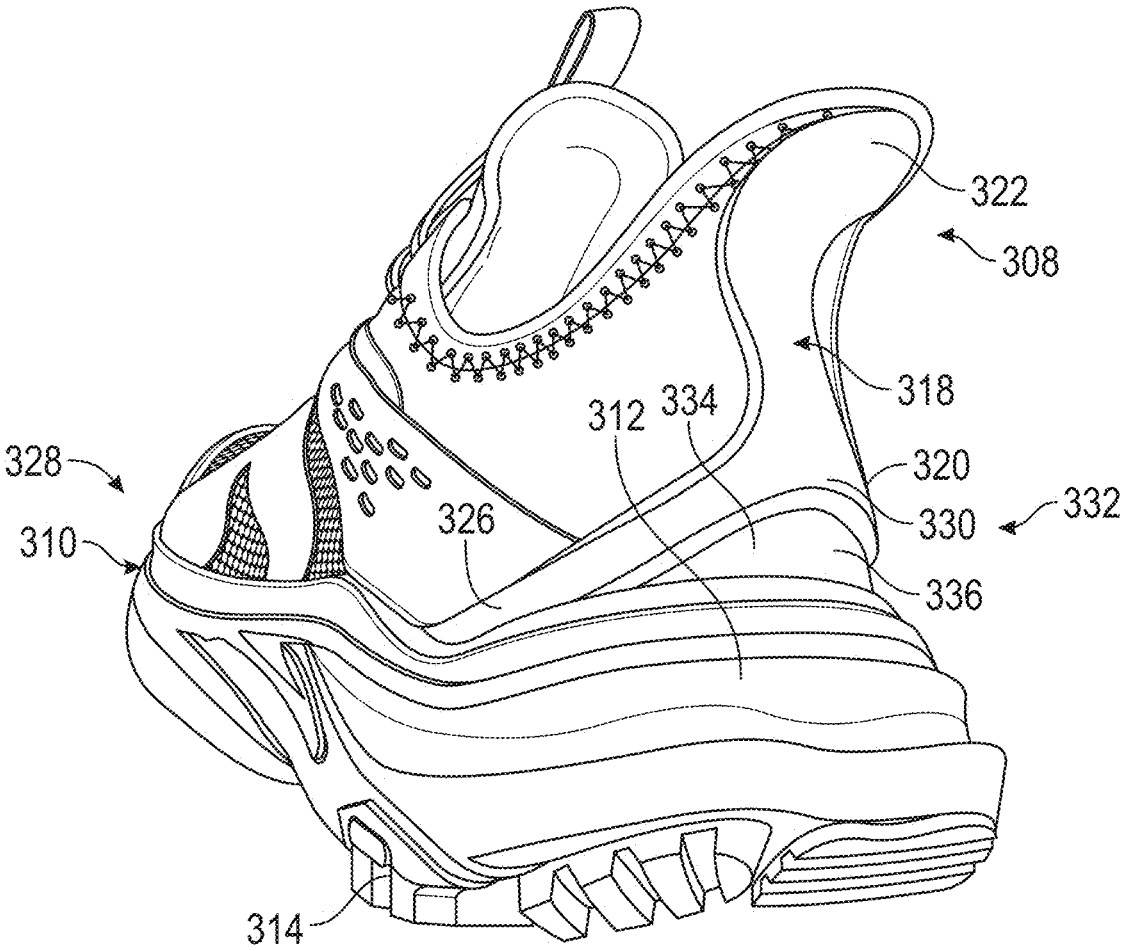
FIG. 10A is a rear perspective view of a further embodiment of the article of footwear.
Figure 10C:
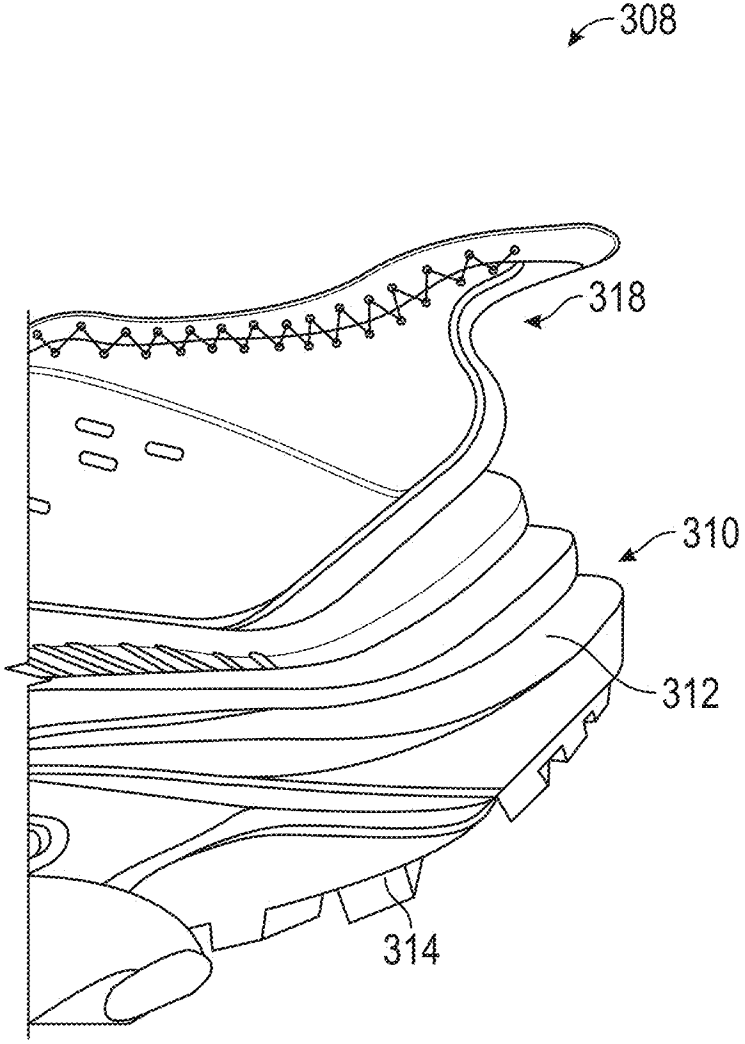
FIG. 10C is a fragmentary side view of the article of footwear of FIG. 10A, where the heel support is in the flexed position.
Figure 10B:
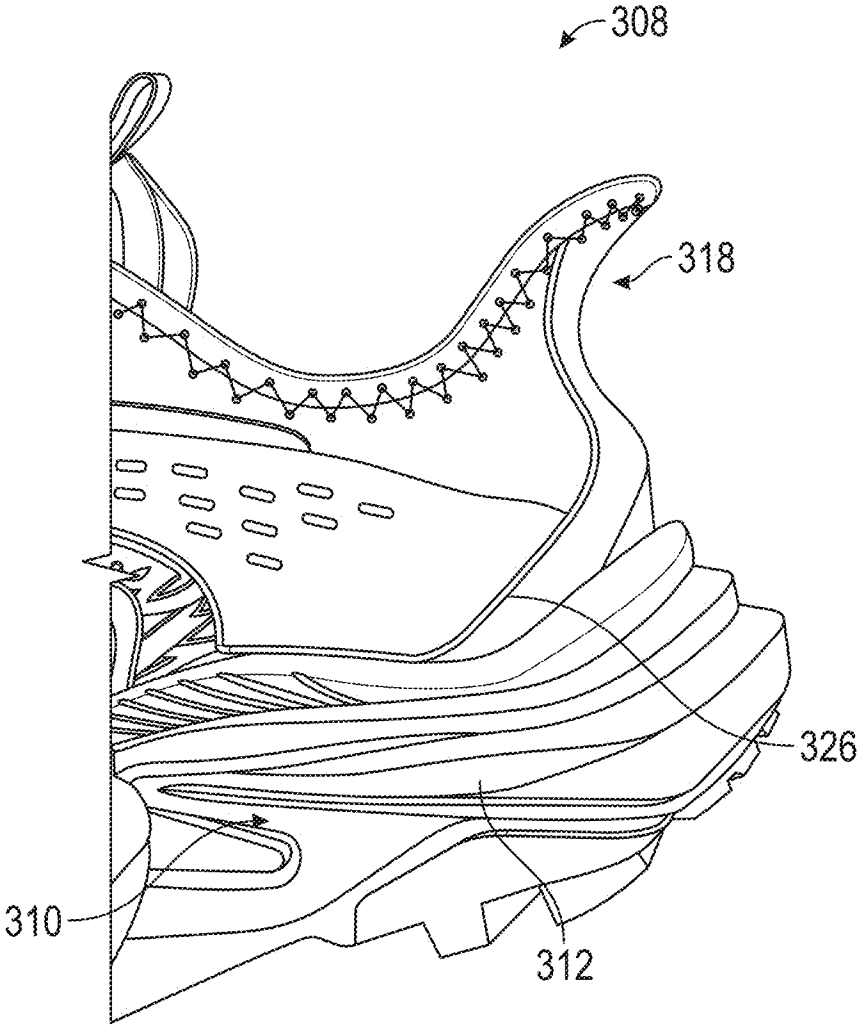
FIG. 10B is a fragmentary side view of the article of footwear of FIG. 10A, where the heel support is in a non-flexed position.

Referring to FIGS. 10A, 10B and 10C, another embodiment of the article of footwear is shown where the article of footwear 308 includes a sole 310 having a midsole 312 and an outsole 314 attached to a bottom surface of the midsole, and an upper 316 attached to an upper surface of the midsole. In this embodiment, the heel support 318 includes a body 320 having a main member 322 extending along a central part of the heel 324 of the upper 316, a lateral member 326 that extends from the main member 322 and downwardly at an angle along the lateral side 328 of the upper, and a medial member 330 that extends from the main member 322 and downwardly at an angle along the medial side 332 of the upper 316. As shown, there is a space 334 between the bottom end 336 of the heel support 318 and the midsole 312. In use, the heel support 318 functions as described above. It should be appreciated that the bottom end of the heel support 318 may be attached to the midsole 312, a portion of the heel support 318 may be attached to the midsole 312 or the entire bottom end of the heel support 318 may be spaced from the midsole 312 and solely attached to the upper 316.

Referring to FIGS. 1-4, overall, the combination of the inner support 34 and the outer support 36 of the upper 24 provides enhanced comfort, support and control to a user's feet during movement, such as during walking, jogging and running. Specifically, positioning the strap assembly 58 of the outer support 36 on the inner support 34 and having two strap connecting points on the lateral side 44 of the sole 22 and three strap connecting points on the medial side 42 of the sole 22 enables the first strap 60 to be adjustably attached between the medial and lateral sides of the sole to form a criss-cross w-shaped pattern over the top of a user's feet to wrap the user's feet in at least three areas, namely, the forefoot area, the midfoot are and/or arch area and the rear area (below the ankle) of the feet, and enhance the support to the medial side of the foot during movement on different terrain.

While particular embodiments of the present article of footwear are shown and described, it will be appreciated by those skilled in the art that changes and modifications may be made thereto without departing from the invention in its broader aspects and as set forth in the following claims.

What is claimed is:

1. An article of footwear comprising:

a sole; and an upper attached to said sole, said upper including an inner support and an outer support, wherein the outer support is positioned on the inner support and includes a strap assembly, said sole including two connecting members on a lateral side of said sole and three connecting members on a medial side of said sole;

said strap assembly including a plurality of straps that extend between said three connecting members on the medial side of said sole and said two connecting members on the lateral side of said sole, wherein at least one of said plurality of straps is connected to said two connecting members on said on said lateral side of said sole and to said three connecting members on said medial side of said sole.

2. The article of footwear of claim 1, wherein a second strap of said plurality of straps is positioned adjacent to a foot opening and extending between the medial side and the lateral side of said sole.

3. The article of footwear of claim 2, wherein a third strap of said plurality of straps extends from the lateral side to the medial said of the sole and about a heel member of said inner support.

4. The article of footwear of claim 1, wherein a position of at least one of said plurality of straps is adjustable.

5. The article of footwear of claim 1, wherein said inner support is made with a stretchable fabric material.

6. The article of footwear of claim 1, wherein said inner support includes a front portion and a rear portion, said front portion extending between said lateral side and said medial side of said sole and having a width that gradually increases from said lateral side to said medial side of said sole.

7. The article of footwear of claim 1, wherein said strap assembly of said outer support extends over said front portion and said rear portion of said inner support.

8. The article of footwear of claim 1, wherein said inner support includes a tongue that enables a user to grasp and move said inner support for insertion of a user's foot in a foot opening in said upper.

9. An upper for an article of footwear comprising:

an inner support and an outer support, wherein the outer support is positioned on the inner support and includes a strap assembly, said strap assembly including a plurality of straps that extend between a medial side and a lateral side of said sole, wherein at least one strap of said plurality of straps is connected to two connecting points on said lateral side of said sole and to three connecting points on said medial side of said sole.

10. The upper of claim 9, wherein a second strap of said plurality of straps is positioned adjacent to a foot opening and extending between the medial side and the lateral side of said sole.

11. The upper of claim 10, wherein a third strap of said plurality of straps extends from the lateral side to the medial said of the sole and about a heel member of said inner support.

12. The upper of claim 10, wherein a position of an end of said second strap is adjustable.

13. The upper of claim 9, wherein a position of an end of said at least one strap of said plurality of straps is adjustable.

14. The upper of claim 9, wherein said inner support is made with a stretchable fabric material.

15. The upper of claim 9, wherein said inner support includes a front portion and a rear portion that are connected together, said front portion extending between said lateral side and said medial side of said sole and having a width that gradually increases from said lateral side to said medial side of said sole.

16. The upper of claim 15, wherein said strap assembly of said outer support extends over said front portion and said rear portion of said inner support.

17. The upper of claim 9, wherein said inner support includes a tongue that enables a user to grasp and move said inner support for insertion of a user's foot in a foot opening in said upper.

* * * * *